US009931255B2

(12) United States Patent
Haigh

(10) Patent No.: US 9,931,255 B2
(45) Date of Patent: Apr. 3, 2018

(54) HANDLE DEVICE FOR FOLDABLE WHEELCHAIRS

(71) Applicant: CENTICARE Corporation, Minnetonka, MN (US)

(72) Inventor: James H. Haigh, Eden Prairie, MN (US)

(73) Assignee: CENTICARE Corporation, Minnetonka, MN (US)

( * ) Notice: Subject to any disclaimer, the term of this patent is extended or adjusted under 35 U.S.C. 154(b) by 0 days.

(21) Appl. No.: 15/178,481

(22) Filed: Jun. 9, 2016

(65) Prior Publication Data

US 2016/0361214 A1 Dec. 15, 2016

Related U.S. Application Data

(60) Provisional application No. 62/173,536, filed on Jun. 10, 2015.

(51) Int. Cl.
*A61G 5/10* (2006.01)
*A61G 5/08* (2006.01)

(52) U.S. Cl.
CPC ..... *A61G 5/10* (2013.01); *A61G 5/08* (2013.01); *A61G 5/0816* (2016.11)

(58) Field of Classification Search
CPC ..... A61G 5/08; A61G 5/10; A61G 5/0816; A61G 5/0825
See application file for complete search history.

(56) References Cited

U.S. PATENT DOCUMENTS

| | | | | |
|---|---|---|---|---|
| 4,542,918 | A | 9/1985 | Singleton | |
| 4,863,181 | A | 9/1989 | Howle | |
| 5,044,650 | A | 9/1991 | Eberle, Jr. | |
| 5,244,225 | A * | 9/1993 | Frycek | A61G 5/10 280/304.1 |
| 5,290,055 | A | 3/1994 | Treat, Jr. | |
| 5,568,933 | A | 10/1996 | Mizuno | |

(Continued)

OTHER PUBLICATIONS

L.H.V. Van Der Woude, C.M. Van Koningsbruggen, A.L. Kroes and I. Kingma, Effect of Push Handle Height on Net Moments and Forces on the Musculoskeletal System During Standardized Wheelchair Pushing Tasks, Prosthetics and Orthotics International, 1995, vol. 19, pp. 188-201.

*Primary Examiner* — Joseph M Rocca
*Assistant Examiner* — Michael R Stabley
(74) *Attorney, Agent, or Firm* — DuFault Law Firm, P.C.; Dustin R. DuFault

(57) ABSTRACT

A handle device for use with a collapsible wheelchair, the wheelchair positionable between a first working position and a second collapsed position. The wheelchair having first and second generally horizontal handlebars extending rearward to facilitate movement of the wheelchair. The handle device comprising first and second substantially "L"-shaped members, each "L"-shaped member having a lower portion and an upper vertically oriented portion. The lower portion is adapted to receive the respective first and second horizontal handlebars therein. The upper portion extends substantially perpendicular to the lower portion, wherein the upper portion of each member upwardly extends beyond a height of the chair allowing the user to grasp each member without flexion of the torso.

5 Claims, 7 Drawing Sheets

(56) References Cited

U.S. PATENT DOCUMENTS

| | | | | |
|---|---|---|---|---|
| D407,672 | S * | 4/1999 | Wells | D12/133 |
| 5,915,712 | A | 6/1999 | Stephenson et al. | |
| 6,182,529 | B1 | 2/2001 | White | |
| 7,500,689 | B2 | 3/2009 | Pastemak et al. | |
| 7,694,606 | B1 | 4/2010 | Williams | |
| 7,886,854 | B2 | 2/2011 | Chiu | |
| 8,215,652 | B2 | 7/2012 | Dashew et al. | |
| 8,234,755 | B1 * | 8/2012 | Brand | B25G 1/04 16/113.1 |
| 8,641,078 | B2 | 2/2014 | Yang | |
| D766,140 | S * | 9/2016 | Chun | D12/133 |
| 2005/0211011 | A1 | 9/2005 | Victor et al. | |
| 2013/0104691 | A1 | 5/2013 | Chesner et al. | |

* cited by examiner

HANDLE DEVICE FOR FOLDABLE WHEELCHAIRS

CROSS-REFERENCE TO RELATED APPLICATION

This application claims the benefit of U.S. Provisional Patent Application No. 62/173,536, filed on Jun. 10, 2015, the entirety of which is hereby incorporated herein by reference.

BACKGROUND OF INVENTION

The present invention is generally directed at wheelchairs. More specifically, the present invention includes a pair of ergonomic extension handles attachable to existing wheelchair handlebars such that the extension handles are positioned in a generally upward direction as opposed to a generally horizontal direction.

Wheelchairs are well known in the art as a means of assisting or transporting those who have a difficult time of walking, or cannot walk, on their own. Foldable wheelchairs, especially those that bring opposing sides together, are also well known in the art, especially as a means of reducing the overall footprint of a wheelchair so that it can be conveniently stored or more easily placed inside a vehicle during transport. This is especially important in areas and facilities where there are a high volume of wheelchairs with limited storage area for keeping the wheelchairs when not in use, including for example hospitals and airports.

There exist in the art a wide variety of examples which attempt to reduce the overall size of the wheelchair in its folded state so as to take up as little space as possible.

U.S. Pat. No. 4,542,918 suggests a foldable wheelchair having two rearwardly extending handlebars by which an assistant can grasp to push and maneuver the wheelchair. However, because of the positioning of the handlebars, most assistants must flexion their torso, or bend downward, when grasping the handlebars in maneuvering the wheelchair. Further, it is also generally necessary that the assistant grip the handlebars with their wrists bent at a downward angle, or wherein the wrist is positioned with ulnar deviation. Both torso flexion and ulnar deviation of the wrist can lead to discomfort and back or wrist pain as both these positions are non-relaxed positions resulting in muscle tension and strain. Such occurrences are drastically increased in situations where, such as in hospitals or airports, assistants may be pushing wheelchairs for more than six hours a day.

U.S. Pat. No. 5,915,712 suggests a handgrip crossbar attachable to the handlebars of a wheelchair. However, because of the configuration of the crossbar and how it attaches to the handlebars of the wheelchair, the wheelchair is incapable of being folded without removal of the crossbar. Moreover, because of the positioning of the crossbar when attached to the wheelchair handlebars, most assistants must flexion their torso when grasping the crossbar in maneuvering the wheelchair. Further, it is necessary that the assistant grip the handlebars with their wrists rotated such that the palms are downward facing, or supination. Both torso flexion and supination of the wrist can lead to discomfort and back or wrist pain as both these positions are non-relaxed positions resulting in muscle tension and strain.

U.S. Pat. App. Pub. No. 2013/01044691 suggests a handgrip attachable to a wheelchair handlebar. However, it is again necessary that the assistant grip the handgrip with their back bent and their wrists supinated, resulting in both back and wrist discomfort.

U.S. Pat. No. 7,694,606 suggests a wheelchair handle for use on a wheelchair handlebar. However, the wheelchair handle does not accommodate for differing heights of various users, ultimately causing torso flexion when gripping. Further, the wheelchair handle rearwardly extends past the wheels of the wheelchair, thereby increasing the footprint of the wheelchair.

Another problem that has arisen with the widespread of use of foldable wheelchairs, especially at hospitals and airports, is their theft. Because by their very nature foldable wheelchairs can be made compact and easily fit into a vehicle, hospitals and airports have experienced high rates of theft of the foldable wheelchairs. This can lead to annual losses in the tens of thousands of dollars, if not more, for large hospitals and airports. Measures to reduce theft, and yet keep the wheelchairs at these facilities readily accessible to patients or passengers who need to use a wheelchair, have thus far been unsuccessful.

There therefore exists a need in the art to provide handles for foldable wheelchairs that can be grasped by assistants of varying heights which do not require the assistant to bend over or hunch downward when maneuvering the wheelchair, to grasp the handles with the wrist in a neutral position, and which do not interfere with the foldable nature of the wheelchair. There also exists a need in the art to provide foldable wheelchairs with a means to reduce or prevent theft of the wheelchair from large facilities such as airports and hospitals.

BRIEF SUMMARY OF INVENTION

A handle device in accordance with the present invention includes a member having a generally "L"-shaped configuration, including a first horizontal connecting portion and a second vertical grasping portion. The first horizontal connecting portion is adapted to receive a rearwardly extending handlebar of a wheelchair. A locking mechanism frictionally engages the horizontal connecting portion to the rearwardly extending handlebar at a selected position. The second vertical grasping portion extends upwardly such that an assistant can grasp the second vertical portion to maneuver the wheelchair with a neutral grip without any torso flexion. No portion of the handle device extends past a rearwardmost vertical plane as defined by the rearward edges of rear wheels of the wheelchair. When a pair of the handle devices in accordance with the present invention are attached to opposing handlebars of a foldable wheelchair, the handle device do not interfere with the foldable nature of the wheelchair. Further, the second vertical portion of the handle device may be extended to a height such that the wheelchair in its folded state can not be easily placed in a vehicle, such that the handle device further acts as a theft deterrent.

DESCRIPTION OF INVENTION

Figure 1:
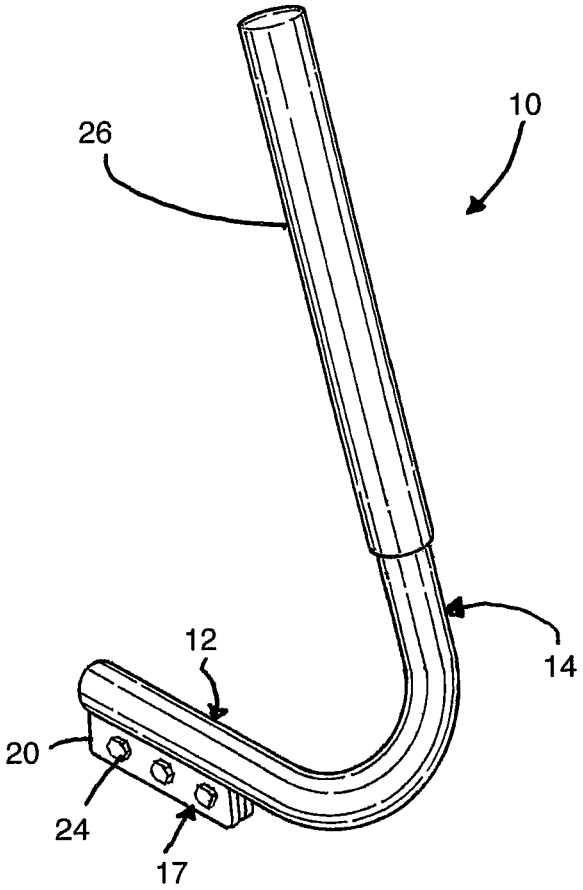
FIG. 1 is a perspective view of a handle device in accordance with the present invention.
Figure 2:
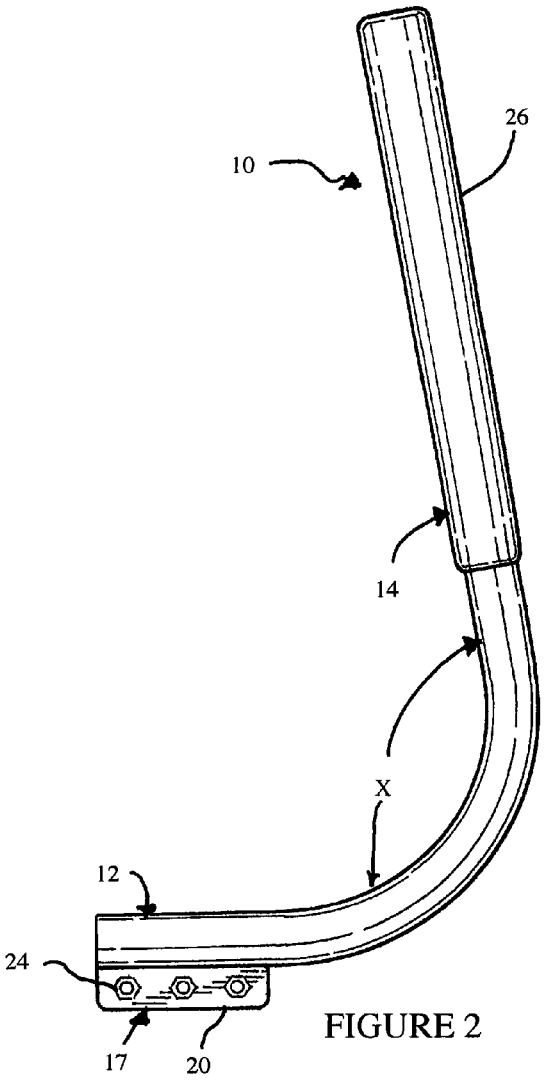
FIG. 2 is a side view of the handle device in accordance with the present invention.

A wheelchair handle device of the present invention is generally indicated at 10 in FIG. 1. The handle device 10 is configured from a hollow tube or pipe, preferably metallic, but can be made from any suitable material, including flat materials. The handle device 10 has a generally "L"-shaped configuration, including a first lower connecting portion 12 and a second upper grasping portion 14. The first lower connection portion 12 and the second upper grasping portion 14 are preferably off-set from one another by an angle x of approximately 90 degrees, as illustrated in FIG. 2. However, it is well within the scope of the present invention that this off-set angle x be between 70 and 110 degrees to accommodate existing wheelchair handlebars 16 from a variety of manufacturers which may have an upward or downward canted handlebar 16. The first lower connecting portion 12 is sized such that the existing wheelchair handlebar 16 is disposable therein in order to attach the handle device 10 to the existing wheelchair handlebar 16.

Figure 3:
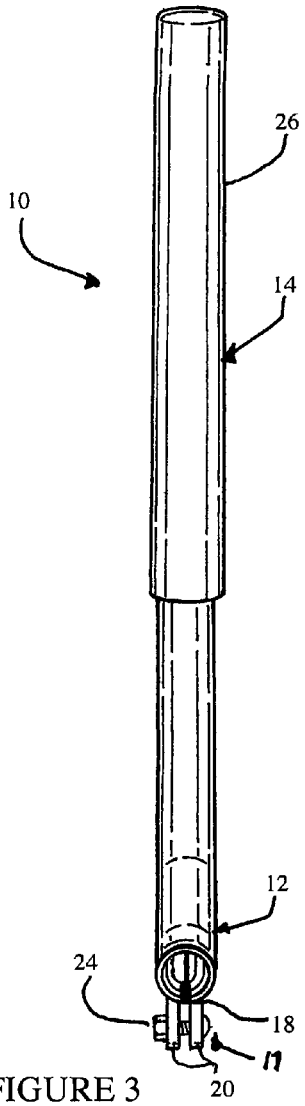
FIG. 3 is a front view of the handle device in accordance with the present invention.
Figure 4:
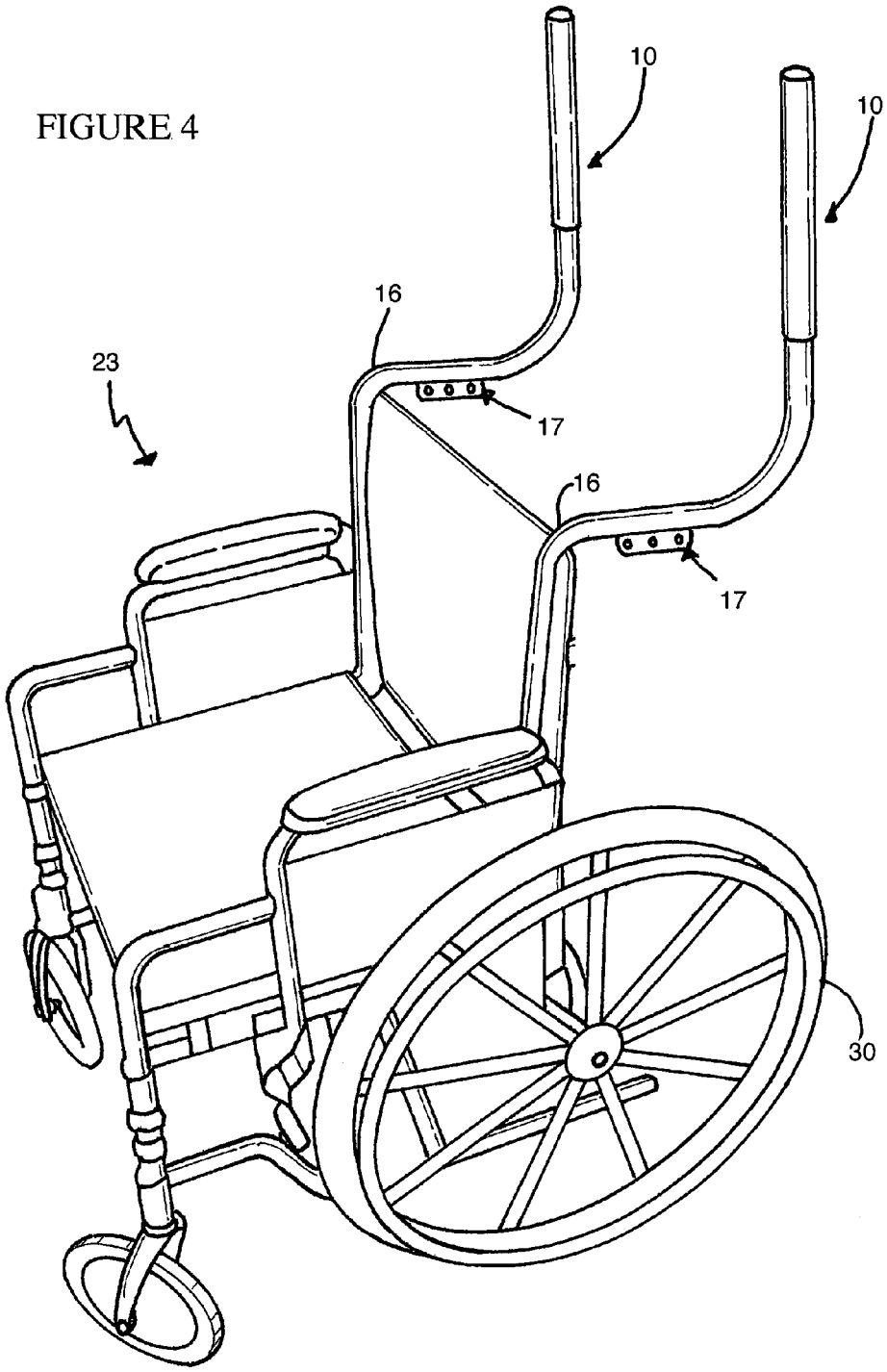
FIG. 4 is a perspective view of a foldable wheelchair in an unfolded open position with a pair of handle devices in accordance with the present invention.

To facilitate the connection of the handle 10 to the handlebar 16, a locking mechanism 17 is provided. As best illustrated in FIG. 3, the locking mechanism is an integral part of the first connecting portion 12 and includes a slot 18 positioned within a relative downward side of the connecting portion 12 extending inwardly from a terminal end. The slot 18 enables the first connecting portion 12 to inwardly flex in order to provide a compression fit about the wheelchair handlebar 16 when disposed within the first connecting portion 12. Plates 20 affix to the connecting portion 12 along each opposing edge of the slot 18. With the wheelchair handlebar 16 disposed within the first connecting portion 12, each attaching plate 20 is urged toward one another by a set of screws/bolts 24 disposed within apertures 22 contained within the plates 20. Once the screws/bolts 24 are tightened, the handle 10 is firmly attached to the wheelchair handlebar 16, as best illustrated in FIG. 4 with the foldable wheelchair 23 in a first open position. A rubber or plastic grip 26 disposes onto the second grasping portion 14 of the handle device 10 to facilitate gripping by the user or assistant.

Figure 5:
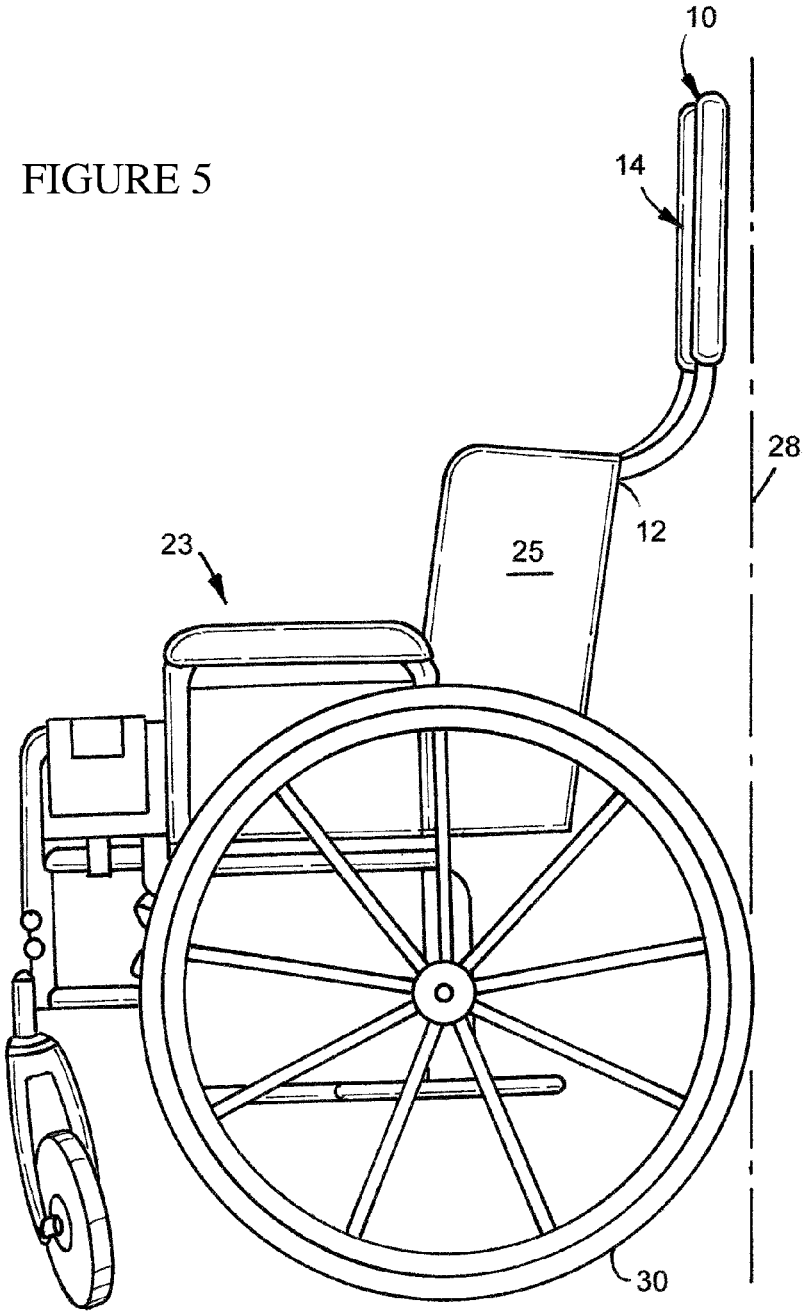
FIG. 5 is a side view of a wheelchair with a pair of handle devices in accordance with the present invention.

As illustrated in FIG. 5, no portion of the handle device 10, neither the first connecting portion 12 nor the second grasping portion 14, rearwardly extend past a vertical plane 28 running tangentially to the most rear portion of the wheelchair wheel 30. In not extending past this vertical plane 28, the handle devices 10 do not increase the footprint of the wheelchair, nor can the handle devices 10 become entangled with handle devices of other wheelchairs 23 when in close proximity to one another. However, it is within the scope of the present invention to allow the handle device 10 to extend past vertical plane 28, especially in circumstances where the manufacturer of the wheelchair 23 positions the wheels 30 in a more rearward position.

Figure 6:
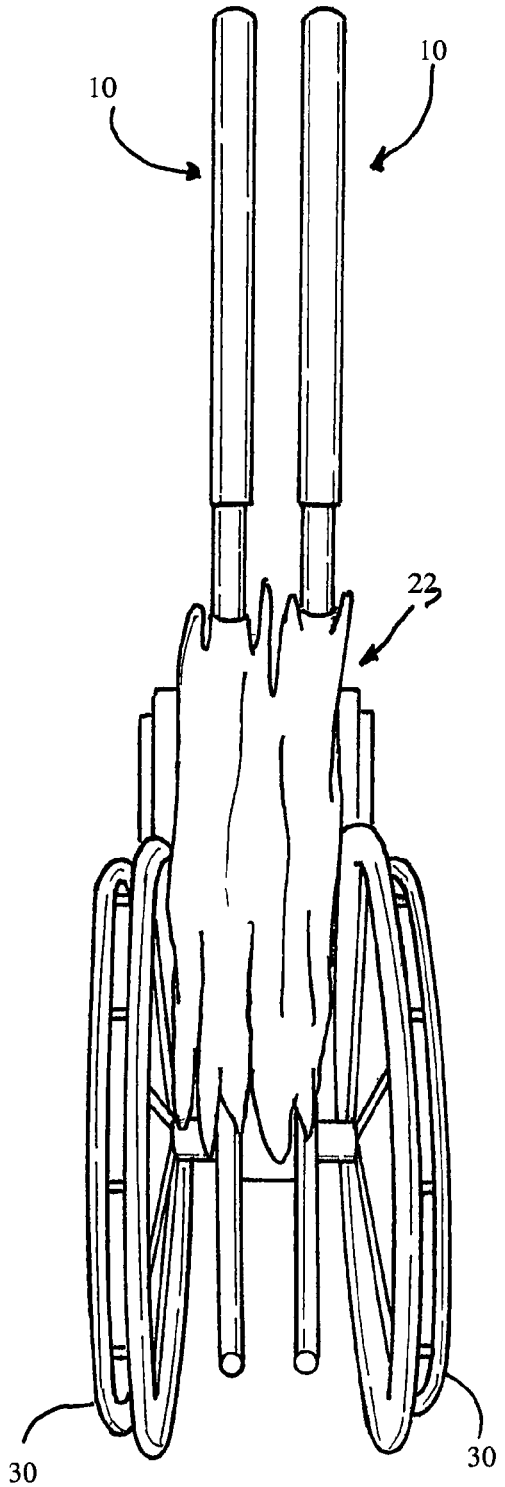
FIG. 6 is a back view of the foldable wheelchair in a folded closed position with a pair of handle devices in accordance with the present invention.

As illustrated in FIG. 6, when the wheelchair is positioned into a second folded position, the handle devices 10 do not have to be removed as they do not interfere with either the positioning of the wheelchair 23 into the second folded position or with one another. It should also be noted that, while not included in FIG. 4, the wheelchair 23 as illustrated in FIG. 5 includes a cover 25 positioned over each locking mechanism 17 to provide a more aesthetic look, as well as prevent objects or persons entangling with the locking mechanism 17.

Figure 7:
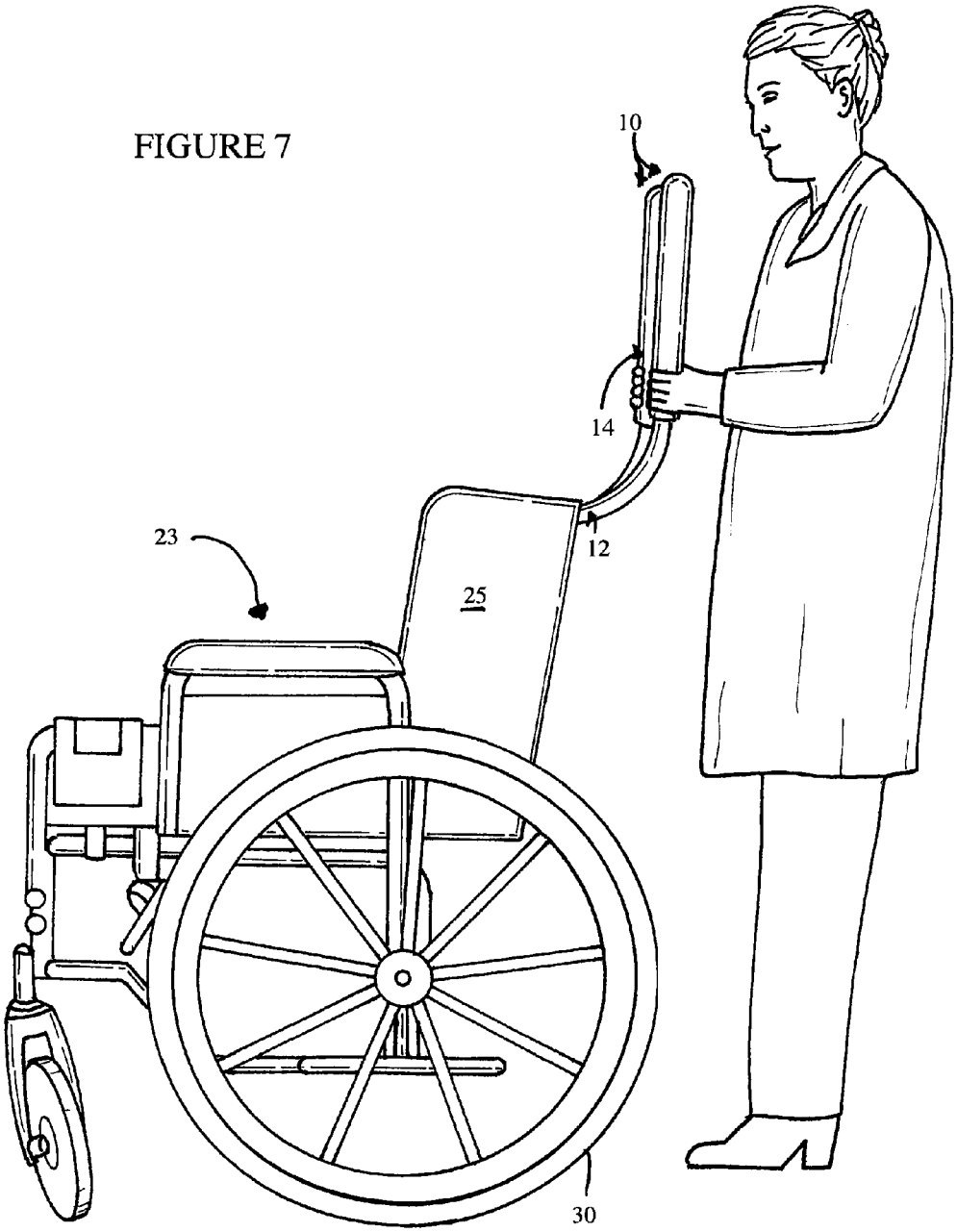
FIG. 7 is a side view of the wheelchair with the handle devices of the present invention gripped by an assistant.

As is known in the medical arts, the wrist is a complex series of joints that are formed around the carpal bones and the forearm bones including of the radius and the ulna. The wrist is capable of three sets of distinct movements, namely flexion and extension, supination and pronation, as well as ulnar deviation (ulnar flexion) and radial deviation (radial flexion). Ulnar deviation, otherwise known as ulnar flexion, is the movement of bending the wrist to the little finger, or ulnar bone, side. Supination describes the movement of rotating the forearm into a palm up position. Pronation describes the movement of rotating the forearm into a palm down position. Flexion describes the movement of bending the palm down, towards the wrist. The neutral position of the wrist is that position where the wrist is in straight alignment with the forearm: no flexion, extension, radial or ulnar deviation. The wrist is at the mid-point between supination and pronation. This is commonly called the handshake position. As illustrated in FIG. 7, once the handle device 10 of the present invention is attached to each existing wheelchair handlebar 16, the user or assistant can grasp the grasping portion 14 of each handle device 10 with the wrist in the relaxed handshake position, accommodating assistants from five feet in height to greater than six feet in height. The user or assistant also grips each second grasping portion 14 without having to bend or hunch over. The user can then maneuver the wheelchair 23 while standing in a generally upright position, thereby decreasing or eliminating discomfort which occurs in maneuvering wheelchairs of the prior art. Further, because of the height where the assistant is allowed to grasp the grasping portion 14, the assistant can get greater leverage, if necessary, by slightly raising the position the hands are on each grasping portion 14.

Figure 8:
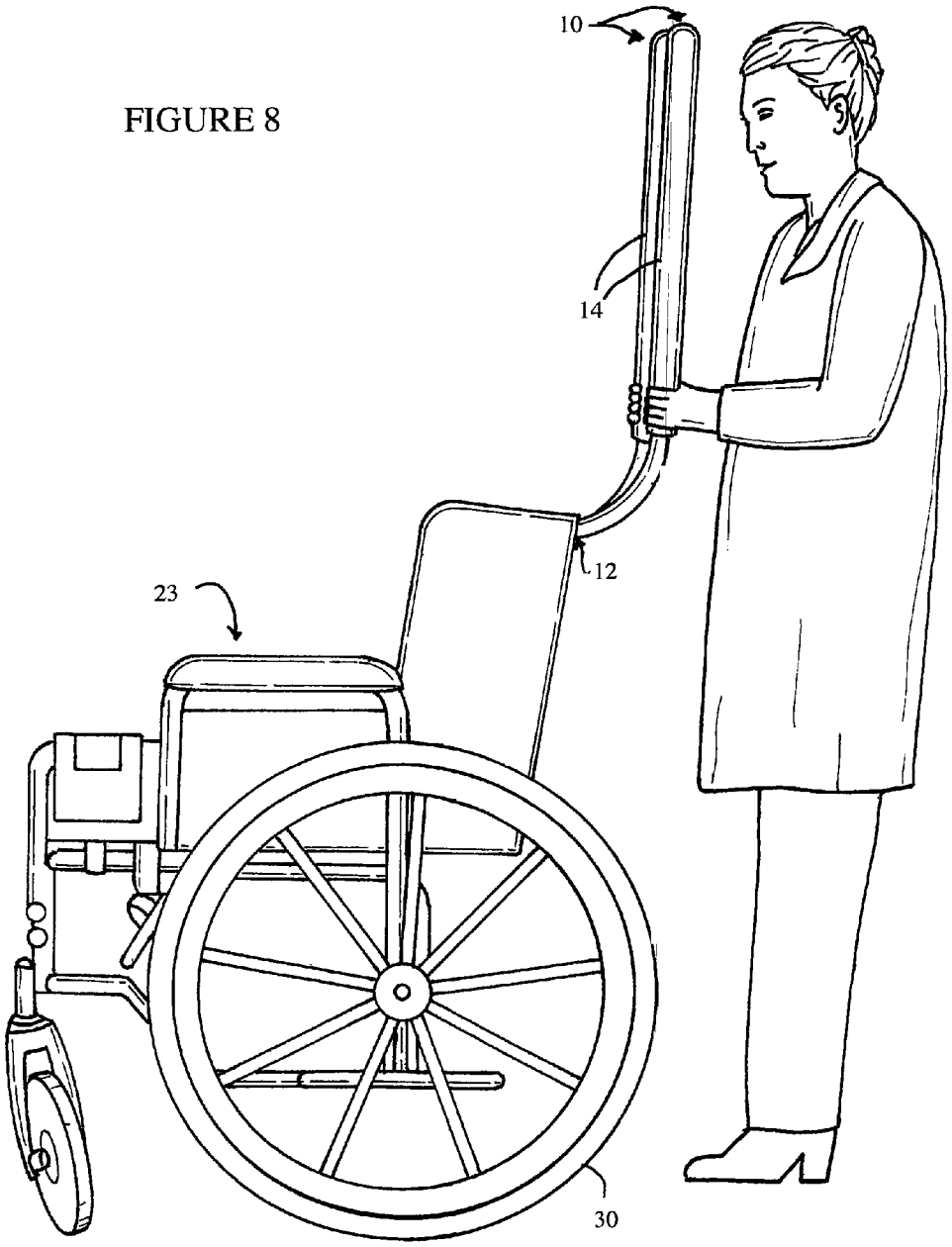
FIG. 8 is a side view of the wheelchair with an alternate embodiment of the handle devices of the present invention.

FIG. 8 illustrates an alternative embodiment of the handle device 10 wherein the length of the second upper gripping portion 14 has been increased. In so doing, it has been discovered that handle devices 10 having the increased second upper gripping portion 14 act as theft deterrents, especially at airports and hospitals. The handle device 10 as illustrated in FIG. 8 provides added visibility so that those attempting to remove the device from the facilities will be more easily seen. The handle device 10 as illustrated in FIG. 8 also makes it extremely difficult to stow the foldable wheelchair into a car or van, thereby drastically reducing the number of wheelchairs taken from airports and hospitals.

Although the present invention has been described with reference to preferred embodiments, workers skilled in the art will recognize that changes may be made in form and detail without departing from the spirit and scope of the invention.

The invention claimed is:

1. A handle device for use with a collapsible wheelchair, the wheelchair positionable between a first working position and a second collapsed position, the wheelchair having first and second generally horizontal handlebars extending rearward to facilitate movement of the wheelchair, the handle device comprising first and second substantially "L"-shaped members, each "L"-shaped member having a lower portion and an upper vertically oriented portion, the lower portion adapted to receive the respective first and second horizontal handlebars therein, the upper portion extending substantially perpendicular to the lower portion, wherein the upper portion of each member upwardly extends beyond a height of the chair allowing the user to grasp each member without flexion of the torso, each "L"-shaped member having a locking device for securing each "L"-shaped member to the respective first and second handlebars of the wheelchair, the locking device including a slot contained on each lower portion of the first and second "L"-shaped members, and first and second opposing plates positioned along each side of the slot, each plate containing an aperture, the plates positionable towards one another by screw disposed within the apertures to lock the first "L"-shaped member to the first handlebar and the second "L"-shaped member to the second handlebar, wherein the wheelchair is permitted positioning between the first working position and the second collapsed position without any interference from either the first or the second "L"-shaped member.

2. The handle device of claim 1 wherein the lower portion of each "L"-shaped member is offset by an angle of less than 90 degrees from the respective upper portion.

3. A handle device for use with a collapsible wheelchair, the wheelchair positionable between a first working position and a second collapsed position, the wheelchair having first and second generally horizontal handlebars extending rearward to facilitate movement of the wheelchair, the handle device comprising:

first and second substantially "L"-shaped members, each "L"-shaped member having a lower portion and an upper portion offset from one another by an angle of less than 90 degrees, the lower portion adapted to receive the respective first and second horizontal handlebars therein, the upper portion of each member upwardly extending beyond a height of the chair allowing the user to grasp each member without flexion of the torso, wherein the wheelchair is permitted positioning between the first working position and the second collapsed position without any interference from either the first or the second "L"-shaped member, and wherein no portion of the handle device rearwardly extends past a vertically oriented plane positioned tangentially to a most rearward point of each wheel of the wheelchair; and a locking mechanism to secure the first portion of each "L"-shaped member to the respective horizontal bar of the wheelchair, the locking mechanism including a slot contained on each lower portion of the first and second "L"-shaped members, and first and second opposing plates positioned along each side of the slot, the plates urged towards one another by a screw disposed therein to lock the first "L"-shaped member to the first handlebar and the second "L"-shaped member to the second handlebar.

4. An anti-theft device to prevent theft of a collapsible wheelchair, the wheelchair positionable between a first working position and a second collapsed position, the wheelchair having first and second generally horizontal handlebars extending rearward to facilitate movement of the wheelchair, the anti-theft device comprising first and second substantially "L"-shaped members, each "L"-shaped member having a lower portion and an upper vertically oriented portion, the lower portion adapted to receive and fixedly attach to the respective first and second horizontal handlebars by a locking mechanism, the locking mechanism including a slot contained on each lower portion of the first and second "L"-shaped members, and first and second opposing plates positioned along each side of the slot, the plates positionable towards one another by a screw disposable through the plates to lock the first "L"-shaped member to the first handlebar and the second "L"-shaped member to the second handlebar, wherein the upper portion extends upwardly beyond a height of the chair, wherein the height of the upper portion prevents the wheelchair to be placed within a vehicle, wherein the wheelchair is permitted positioning between the first working position and the second collapsed position without any interference from either the first or the second "L"-shaped member, and wherein no portion of the device rearwardly extends past a vertically oriented plane positioned tangentially to a most rearward point of each wheel of the wheelchair.

5. The anti-theft device of claim 4 wherein the lower portion of each "L"-shaped member is positioned less than 90 degrees from the respective upper portion.

* * * * *